US006174161B1

(12) United States Patent
Slavejkov et al.

(10) Patent No.: US 6,174,161 B1
(45) Date of Patent: Jan. 16, 2001

(54) METHOD AND APPARATUS FOR PARTIAL OXIDATION OF BLACK LIQUOR, LIQUID FUELS AND SLURRIES

(75) Inventors: Aleksandar G. Slavejkov, Allentown; Bryan C. Hoke, Jr.; Thomas M. Gosling, both of Bethlehem; John J. Lewnard, Emaus; David R. Ruprecht, New Tripoli, all of PA (US)

(73) Assignee: Air Products and Chemical, Inc., Allentown, PA (US)

( * ) Notice: Under 35 U.S.C. 154(b), the term of this patent shall be extended for 0 days.

(21) Appl. No.: 09/364,438

(22) Filed: Jul. 30, 1999

(51) Int. Cl.[7] ..... F23D 11/00

(52) U.S. Cl. ..... 431/159; 431/183; 431/187; 48/197 R; 239/406; 239/434.5

(58) Field of Search ..... 431/159, 181, 431/182, 183, 187, 185, 9, 10, 350; 239/406, 434, 434.5, 426; 48/197 R

(56) References Cited

U.S. PATENT DOCUMENTS

| | | | | |
|---|---|---|---|---|
| 4,351,645 | | 9/1982 | Marion et al. . | |
| 4,364,744 | | 12/1982 | Crouch et al. . | |
| 4,371,378 | | 2/1983 | Brent et al. . | |
| 4,525,175 | | 6/1985 | Stellaccio . | |
| 4,559,009 | * | 12/1985 | Marino et al. | 431/187 |
| 4,698,014 | | 10/1987 | Grethe et al. . | |
| 4,701,124 | * | 10/1987 | Maghon et al. | 431/183 |
| 4,857,076 | | 8/1989 | Pearson et al. . | |
| 5,104,310 | | 4/1992 | Saltin . | |
| 5,129,333 | | 7/1992 | Frederick et al. . | |
| 5,352,333 | | 10/1994 | Stigsson . | |
| 5,363,782 | | 11/1994 | Couwels . | |
| 5,393,220 | | 2/1995 | Couwels et al. . | |
| 5,505,615 | * | 4/1996 | Wittteveen | 431/183 |
| 5,513,583 | | 5/1996 | Battista . | |
| 5,617,997 | | 4/1997 | Kobayashi et al. . | |
| 5,632,858 | | 5/1997 | Kitto, Jr. . | |
| 5,653,916 | | 8/1997 | Disselhorst et al. . | |
| 5,683,549 | | 11/1997 | Stigsson . | |
| 5,785,721 | | 7/1998 | Brooker . | |
| 5,790,086 | * | 8/1999 | Masai | 239/434.5 |
| 5,904,477 | | 5/1999 | Van Dam et al. . | |
| 5,944,507 | * | 8/1999 | Feldermann | 239/424 |

* cited by examiner

*Primary Examiner*—James C. Yeung
(74) *Attorney, Agent, or Firm*—John M. Fernbacher

(57) ABSTRACT

Method and apparatus for combusting and/or gasifying a generally viscous liquid or a slurry wherein the liquid or slurry are atomized in a central atomization device within a burner housing the central atomization device using a portion of a gaseous oxidant introduced into the burner to atomize the liquid or slurry as it exits the atomization device.

18 Claims, 3 Drawing Sheets

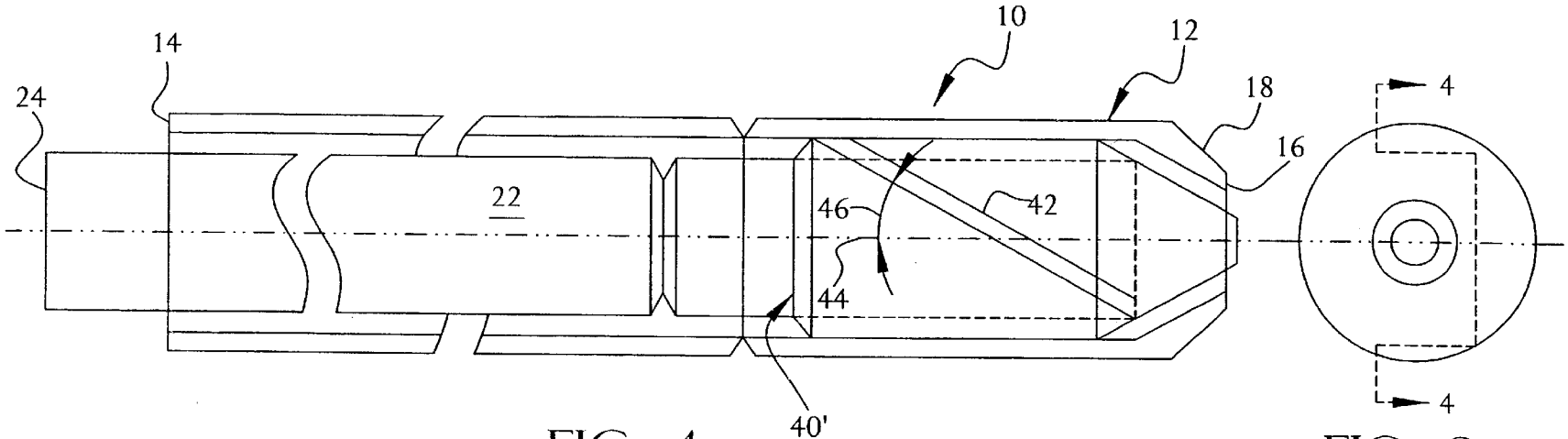
FIG. 3
FIG. 4
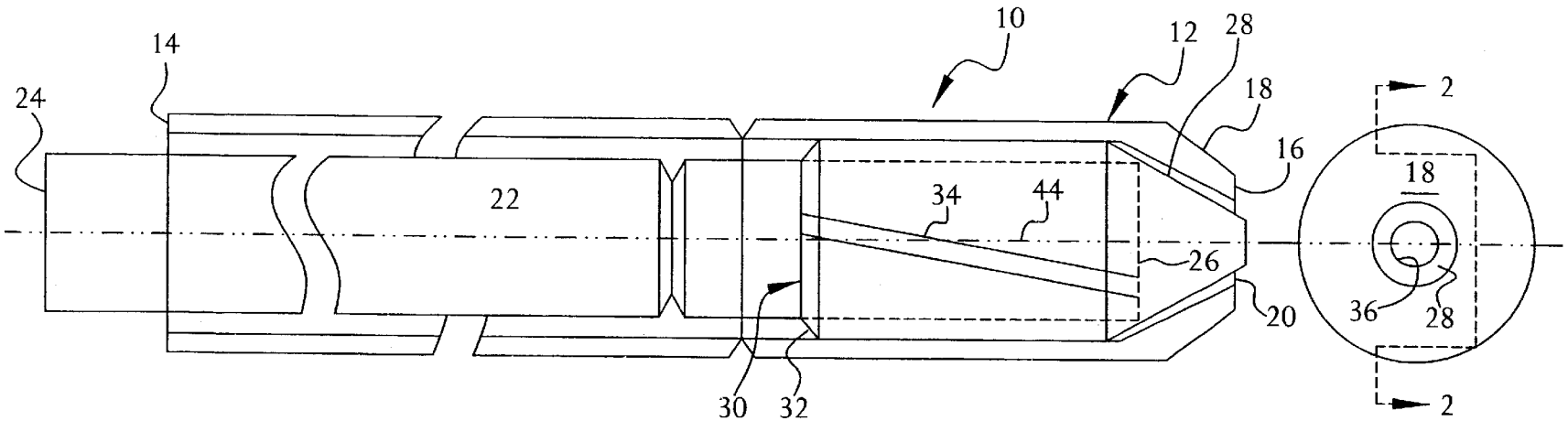
FIG. 1
FIG. 2

METHOD AND APPARATUS FOR PARTIAL OXIDATION OF BLACK LIQUOR, LIQUID FUELS AND SLURRIES

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention pertains to combustion and/or gasification of liquid fuels and/or slurries such as spent liquors used in the manufacture of pulp and paper.

The kraft process for pulping is the dominant method for producing pulp and paper. The kraft process, originally developed and patented in 1884, received great impetus for dominance in the 1930s with the introduction of the Tomlinson recovery furnace, where final evaporation and burning of spent liquor, heat recovery and chemical recovery were combined in one unit. In the kraft process white liquor containing the active cooking chemicals, sodium hydroxide (NaOH) and sodium sulfate ($Na_2S$) is used for cooking the wood chips to separate cellulose fibers from lignin. Spent cooking chemicals and lignin are washed away from the cellulose fibers with water forming a residual stream called black liquor. The black liquor initially containing about 15% solids is concentrated in a series of multiple-effect evaporators and concentrators to approximately 75% solids. The concentrated liquor is then burned in the Tomlinson recovery furnace to recover the fuel value of the black liquor as steam and the chemicals as an inorganic smelt of sodium carbonate ($Na_2CO_3$) and sodium sulfide. The smelt is dissolved in water to form green liquor, which is reacted with quick lime (CaO) to convert $Na_2CO_3$ into NaOH and regenerate the original white liquor.

Tomlinson recovery furnaces have been refined and improved over the years, but the basic technology has some major drawbacks. Because the inorganic pulping chemicals are recovered as a smelt in a large quantity in the bottom of the furnace, the industry was plagued by occasional severe recovery furnace explosions. Tomlinson recovery furnaces also present significant environmental challenges. These furnaces produce large amounts of dust that must be reclaimed by electrostatic precipitators. The Tomlinson recovery furnace has a high cost, both initial capital costs and operation and maintenance costs.

Black liquor gasification is a promising new technology which could be a replacement for Tomlinson recovery boilers and yield higher electrical efficiency, with prospective environmental, safety, and capital cost benefits for kraft mills.

High temperature black liquor gasifiers operate at 950° C. (1650° F.) or higher and produce a fuel gas containing primarily $H_2$, CO, $CO_2$, and $H_2O$ and a molten smelt of inorganic chemicals which is immediately quenched and dissolved into green liquor. High temperature gasification, where temperatures exceed the melting point of the smelt and are typically greater than 900° C. (1650° F.), offers the advantages of higher carbon conversion rates and decreased $H_2S$ generation rates. Black liquor gasifiers can operate at ambient pressure or be pressurized, typically to less than 100 atm. Pressurizing the gasifier allows the equipment size to be reduced, and facilitates feeding the fuel gas to a compression engine or gas turbine.

One of the greatest challenges in gasifying black liquor is in the efficient and reliable introduction and partial combustion of the black liquor in the gasifier. The injector or burner must operate at surrounding temperatures in excess of 950° C., at pressures of 5–25 bar, and in a reducing atmosphere. This has been accomplished in other applications, such as coal and petroleum residue gasification. However, the chemical makeup of black liquor is unique and more problematic than other gasifier feeds. The major inorganic constituents of black liquor, sodium (Na) and sulfur (S) are very corrosive, particularly at the target operating temperatures. The injector/burner must be able to withstand the corrosive and erosive attack of high temperature, high velocity product gas with entrained smelt particles. The burner must also be able to accommodate particulates such as sand particles which can come in with the wood chips. Even with these special challenges, the injector/burner must be able to operate with minimal maintenance to insure that the gasifier can provide an on-stream availability of 98%, which can be achieved from a modern Tomlinson recovery furnaces.

To enable reliable operation with oxygen the burner has to be able to achieve proper atomization and to survive higher flame temperatures produced by oxygen combustion. This means that the droplets should be of optimum size to enable complete carbon burnout, yet not cause over-oxidation of inorganics by exposing them to locally oxidizing regions of the high temperature oxygen flame. There is an on-going discussion among the experts on what exactly is this optimum droplet size. Such information is necessary for the atomizer selection.

Atomization of black liquor for gasification can be achieved using either a pressure or a twin-fluid atomizer. Pressure atomizers, are successfully used for combustion and gasification of coal slurries. However, they have a number of drawbacks, one of the main problems being limited turndown ratio. Pressure atomizers can achieve proper atomization only within limited flow range. To offset this, burner designers use multitude of orifices, usually arranged in a circular pattern within a burner. All orifices are used for atomization during a high firing rate operation. However, for a reduced capacity, some orifices are shut down instead of reducing the fuel flow proportionally. This mode of intermittent operation of some of the orifices causes flame shape variations and requires water cooling of the burner parts exposed to the flame. Another main limitation is erosion and plugging. Pressure atomizers require small orifices for proper atomization. To remedy the turndown ration limitation, the use of multiple orifices reduces average orifice diameter even further. This makes the pressure atomizers susceptible to plugging and/or erosion. A third major limitation is water cooling. Burners utilizing pressure atomizers usually require water cooling which can cause condensation, corrosion, and/or build-up of material on the burner. In turn, this can cause burner malfunction and in extreme cases catastrophic failure.

Another type of nozzle that can be used for black liquor atomization are twin-fluid atomizers. These can be divided into two categories, e.g. internal-mixing, and external-mixing nozzles.

The internal-mixing nozzles are most commonly used with air as the atomizing media for black liquor combustion in recovery boilers. Their maintenance requirements are generally high, due to the plugging of the internal-mixing chamber. Also, they would not be suitable for oxygen enriched combustion due the potential for burner overheating.

External-mixing nozzles can be used for combustion of black liquor with oxygen. However, the process performance including the burner maintenance requirements and overall durability is determined by the ultimate selection of an optimum atomizer and the method of combining the atomizer assembly within a burner system.

Processes and equipment for gasifying cellulosic waste liquor (black liquor) are disclosed and claimed in U.S. Pat. Nos. 5,632,858, 5,352,333 and 5,683,549.

U.S. Pat. Nos. 5,129,333 and 5,363,782 disclose processes and devices for combusting waste fluids containing particulate matter.

U.S. Pat. No. 5,513,583 discloses an apparatus for burning a coal water slurry.

U.S. Pat. Nos. 4,351,645, 4,371,378, 4,364,744, 4,525,175 5,393,220, 5,653,916, 5,785,721 and 5,904,477 disclose processes and devices for partial oxidation or gasification of hydrocarbon materials.

U.S. Pat. No. 4,698,014 discloses a method and apparatus for atomization of viscous liquids or slurries for combustion or gasification.

U.S. Pat. No. 4,857,076 discloses and claims a burner device for production of a synthesis gas consisting essentially of hydrogen and carbon monoxide.

U.S. Pat. No. 5,104,310 discloses a multi orifice oxy-fuel burner.

U.S. Pat. No. 5,617,997 discloses a narrow spray angle atomizer for combustion of liquid fuels such as oil.

SUMMARY OF THE INVENTION

The present invention pertains to a method and apparatus for partially combusting waste liquid fuels such as black liquor generated during the manufacture of kraft pulp. In particular, the present invention is drawn to a method and apparatus that uses oxygen for the gasification and to support combustion.

In the apparatus aspect, the present invention is a single orifice external-mixing nozzle capable of firing in excess of 400 MMBtu/hr. The waste liquid fuel, e.g., black liquor is introduced by a central tube through a single hole orifice at a relatively low velocity generally not exceeding 200 feet per second (ft/s). An atomizing fluid tube terminating in a nozzle having a complimentary shape to a conical shape on the end of the central tube ends with an annular opening in about the same plane with the waste liquid fuel orifice. During operation of the burner, the relative position of the two orifices can be varied resulting in increased or decreased atomizing efficiency. The atomizing fluid device must include swirl vanes which, depending upon the angle at which they are oriented, can introduce stronger or lighter swirl, affecting the flame shape. The atomizing fluid can be oxidant (oxygen concentration greater than 30%, preferablty greater above 90%), steam, or a mixture of oxidant and steam. Where oxygen is used as both the atomizing fluid and oxidant, less than 80% of the total oxygen needs to be introduced as the atomizing fluid at about between 20 and 80 psig relative to the operating pressure of the reactor within which the burner is disposed. The balance of the oxygen is introduced as combustion oxygen which also functions to shield the atomizing assembly from the harsh environment of the furnace or gasifier within which it is placed. With a device of the present invention the atomizing fluid exits the nozzle at a velocity greater than about 400 feet per second preferably greater than 600 feet per second. Combustion oxygen is introduced through a burner body with or without a swirling motion and continues through a pre-combustor which can be part of the refractory of the gasifier or furnace. Where vanes are employed in the burner body the swirling motion of the combustion oxygen can be used to increase mixing and allow for complete carbon burnout. Another feature of the invention is a pilot burner which is a separate assembly mounted as close as possible to the atomizing assembly. The pilot operates continuously, and in order to maintain a stable pilot flame it must be juxtaposed to the exit of the main atomizing portion of the burner. It would also be possible to introduce a pilot flame from the side of the pre-combustor or it may be possible to have a ignition source such as a piezoelectric igniter positioned adjacent the outlet of the atomization portion of the burner.

Therefore, in one aspect, the present invention is a burner for introducing an oxidant (oxygen concentration greater than 30% preferably above 90% oxygen), and an atomized liquid slurry into a high temperature high pressure gasification vessel comprising in combination: a generally cylindrical burner housing having a first end and a second end, the housing adapted to be mounted into an outer wall of the gasification vessel with the second end of the housing positioned to direct a flame longitudinally within the gasification vessel; means in the housing to direct a flow of gaseous oxidant from proximate a first end toward a second end of the housing; atomization means disposed along a longitudinal axis of the housing and extending from the first end of the housing to proximate the second end of the housing, the atomization means consisting of an outer generally cylindrical conduit having a first end proximate the first end of said housing and a second end defining a converging nozzle, an inner conduit disposed within the outer conduit and of a diameter to define a generally annular passage between said inner and outer conduits with an atomization tip on an end of said second conduit proximate said second end of said first conduit said atomization tip being of a diameter to engage an inner wall of said outer conduit said atomization tip having means in an outer surface to permit atomization fluid, which can be oxidant, steam or a mixture thereof, to flow between said atomization tip and said inner wall of said conduit with a swirling motion, said atomization tip terminating in a converging surface generally complimentary in shape to an inner surface of said conveying nozzle said converging surface of said atomization tip ending in a nozzle orifice in fluid communication with said inner conduit, said inner conduit adapted to conduct said liquid slurry from a first end of said burner to said nozzle end of said atomization means, whereby said atomized liquid slurry exits said atomization means in a swirling flow pattern.

In another aspect, the present invention is a method of introducing a liquid or a slurry into a high pressure vessel at elevated temperature comprising the steps of: introducing liquid or slurry atomized with a gaseous oxidant with a swirling motion along a longitudinal axis of the housing and proximate the second end of the housing; providing a source of ignition proximate the point of introduction of the swirling atomized liquid or slurry; and introducing combustion oxidant through the housing toward the atomized liquid or slurry into said vessel.

BRIEF DESCRIPTION OF THE DRAWINGS

FIG. 1, is a front view of an apparatus according to the present invention.

FIG. 2, is a section taking along the lines 2—2 of FIG. 1.

FIG. 3, is a front view of an alternate embodiment of the atomizer according to the present invention.

FIG. 4, is a section taking along lines 4—4 of FIG. 3.

DETAILED DESCRIPTION OF THE INVENTION

Figure 5:
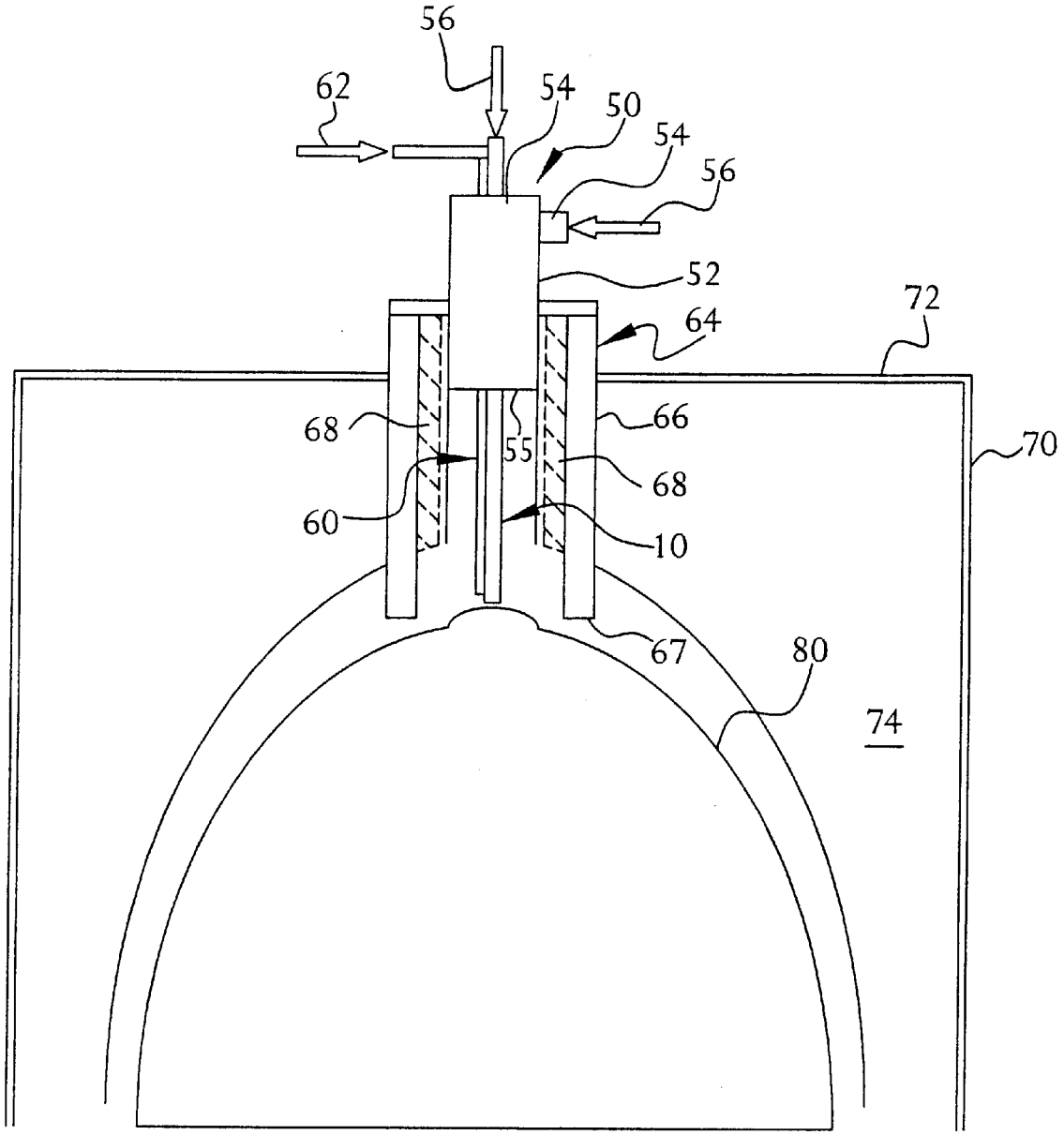
FIG. 5, is a front elevational schematic of an apparatus according to the present invention in a working environment.

Pressure atomizers used for liquid fuels having high solids content, e.g. black liquor, suffer from chronic plugging and/or corrosion problems. Such burners attack the problem by using delivery ends or nozzles with multiple orifices to achieve higher turn down ratio. The liquid fuel exits the nozzle at high velocity causing erosion of the orifice.

Another type of nozzle used for atomizing liquid fuels are internal-mixing twin-fluid atomizers which are also sometimes called emulsion atomizers. The devices also experience problems with high solids content fuels such as black liquor. In addition, they can not safely operate with when oxygen is used for atomization, thus they are limited to using air or stream as an atomization media. Furthermore, internal-mixing twin-fluid atomizers require water cooling to survive high temperature environment such as that found in a black liquor gasification vessel.

A key feature of the present invention is the swirling flow of atomized black liquor exiting the burner. The swirling flow of atomized black liquor causes the flame exiting the burner to expand into an umbrella shape so that non-combusted molten inorganic matter is separated from the products of combustion (flame) and moved toward the walls of the gasification (partial oxidation) vessel. This molten material (smelt) flows down and is collected in the bottom of the gasifier where it dissolves in water to form green liquor.

Referring to FIGS. 1 and 2 there is shown an atomization apparatus 10 which consists of an outer tube or conduit 12, fabricated from a suitable material such as stainless steel which has a first end and 14 end and a second end 16. The first end 14 is adapted to be connected to a source of atomizing fluid, e.g. gaseous oxygen, and the second end 16 terminates in a converging nozzle 18 and a nozzle orifice 20. Disposed inside the outer conduit 12 is an inner conduit 22 which has a first end 24 adapted to be connected to a source of the waste liquid fuel, e.g. black liquor and a second end 26 which terminates in a conical portion 28 of the atomization flow directing device 30. Atomization flow directing device 30 on the outside diameter of conduit 22 is fabricated by making the inner conduit 22 from a single bar of a suitable material, e.g. stainless steel. The conical end 28 of flow directing device 30 is fabricated to fit inside the nozzle portion 18 of conduit 12 as shown in the drawing, thus, defining a space for fluid to flow between surface 28 and the inner portion of the converging end 18 of conduit 12.

Shown in FIG. 2 is one of a plurality of channels or grooves 34 placed in the outer cylindrical surface of flow directing device 30 of the flow directing device 30 to permit atomizing fluid to be directed toward the conical surface 28. In one embodiment of the invention twelve such grooves are equally spaced around the outer circumference of the cylindrical portion of flow directing device 30 with the grooves being generally parallel and disposed at an angle of about 5° to the longitudnal axis of the atomization device 10. However, it is within the scope of the invention to have from four to forty grooves spaced around the circumference of the outer cylindrical surface. The first end 24 of conduit 22 is adapted to receive the waste liquid fuel and direct it down through and out of the end 36 of conical portion 28 of flow directing device 30. As the waste liquid fuel flows out of the orifice 36 it is contacted by the atomizing fluid flowing between surface 28 and the nozzle portion 18 of conduit 12 so that the atomizing fluid contacts the waste liquid fuel, causing atomization thereof.

In the embodiment shown in FIGS. 1 and 2, the atomized black liquor exiting the atomization device or apparatus 10 has a swirling motion imparted to it, which results in another key feature of the invention which is the wide umbrella-like cross-sectional shape to the resulting flame.

FIGS. 3 and 4 show a device similar to that of FIGS. 1 and 2 except that the flow directing device 40 which is identical in shape and function to flow directing device 30 has a plurality of angularly spaced grooves 42 around the circumference. The angular relationship of the grooves 42 to the center line 44 of the atomizing device 10 can be between 5° and a maximum of 60°. As with the device of FIGS. 1 and 2 the grooves are equally spaced, twelve having been found to be satisfactory. In embodiment of FIGS. 1 and 2, the number of grooves can be varied, however, they must be disposed with their longitudnal axes at an angle to the longitudnal axis of the flow directing device 40. The angular disposition of the grooves causes a swirling motion to be imparted to the atomizing fluid which in turn imparts a swirling motion to the atomized black liquor. The greater (steeper) the angle at which the grooves or channels, the greater the swirling effect.

In both the device of FIGS. 1 and 2 and FIGS. 3 and 4 the flow directing devices 30 and 40 can be made with a diameter that is close to the internal diameter of the surrounding tube 12 so that there is a almost a zero clearance between the outer diameter of the flow directing device (30, 40) and the inner diameter of the conduit 12. This permits the user of the device to position the orifice 86 at different positions longitudinally relative to end 16 of conduit 12.

Referring to FIG. 5 the device of FIGS. 3 and 4 can be disposed within the housing 52 of a burner 50. The atomization apparatus 10, preferably with a flow directing device 40, can be placed inside the housing 52 by any well known technique such as using a end plate 54 on the utility end of the burner and internal spiders or like devices, which are well known to a worker skilled in the art to position the atomization device 10. Burner housing 52 contains an inlet port 54 to receive a gaseous oxidant represented by arrow 56. Arrow 58 represents input of both the waste liquid fuel and the oxidant into the atomization device 10. Disposed longitudinally and coextensive with the atomization device 10 is a pilot burner 60 which has an inlet for a fuel such as natural gas and an oxidizer such as oxygen both of which are represented by arrow 62. Such pilot burners are well known in the art. The key with the pilot burner 60 is that it must be coextensive with and extend for almost the entire length of the atomization device to produce a continuous source of ignition adjacent the exit end of the atomization device. Burner 50 can be disposed in a burner block 64 which is lined with a refractory material 66, such burner blocks being well known in the art and used in gasification vessels such as a black liquor gasifier 70 which is oriented in a vertical direction having a entry end 72 and a refractory lining 74.

Burner block 64 may also be fitted with internal surface vanes 68 which can be used to impart a swirling motion to the oxidizing fluid exiting the bottom portion 55 of burner 50.

In one mode the apparatus of the present invention can be used to gasify black liquor in a pressurized black liquor oxidation vessel operated at elevated temperature. Such vessels are oriented vertically, as shown in FIG. 5, with the burner block 66 placed in the upper or top refractory wall 74 of the gasifier. The burner is placed inside of the burner block as shown and the black liquor and atomizing fluid are introduced into the atomization device 10 and a flame or gasified product 80 is produced by the combustion of combustible in the black liquor. As shown in FIG. 5 the atomizing device 10 is extended to a location approximate the bottom end 67 of the burner block 66 so that a wide umbrella like flame 80 is produced. The swirling motion of the atomization fluid and, if present, swirling devices 68 inside the burner block 66 result in hard to throw organic molten salts being conducted to the walls of the gasifier where they descend and are collected at the bottom as a smelt.

The oxidizer exiting housing 52 of burner 50 flows over the atomization device 10 and creates a cooling effect thus eliminating the need for water cooling of the atomization device.

A device according to the present invention operates based upon a mismatch of the velocity between the black liquor or waste liquid fuel exiting atomization device 10 and the velocity of the atomization fluid, e.g. oxygen exiting the atomization device. It has been found that for black liquor oxidation, a flow of less than 200 feet per second of black liquor exiting the atomization nozzle and a flow rate of greater than 400 feet per second of oxygen exiting the atomization device results in effective gasification.

A device according to the present invention has a significant benefit in a gasifier for black liquor which normally operates at a pressure of between 5 and 25 bar and temperatures in excess of 950° C. (1650° F.). In the prior art a separate burner was used to preheat the gasifier to the necessary operating temperature. Thereafter, the preheat burner was physically withdrawn from the gasifier and an atomization burner was inserted in its place to begin gasification of the black liquor. With a device according to the present invention the burner can be used as a preheater by substituting a start-up fuel, e.g. oil, liquid propane, or natural gas, for the waste liquid fuel to preheat the gasifier 70 to the operating temperature. Once the gasifier is at temperature the start-up fuel, e.g. natural gas, can be turned off and waste liquid fuel can be sent through the atomizer. Thus, the burner of the present invention does not require the operator to repressurize or pressurize the gasifier after heating but before introduction of black liquor, thus increasing the probability of having a successful start-up and saving valuable time and energy resources.

Figure 6:
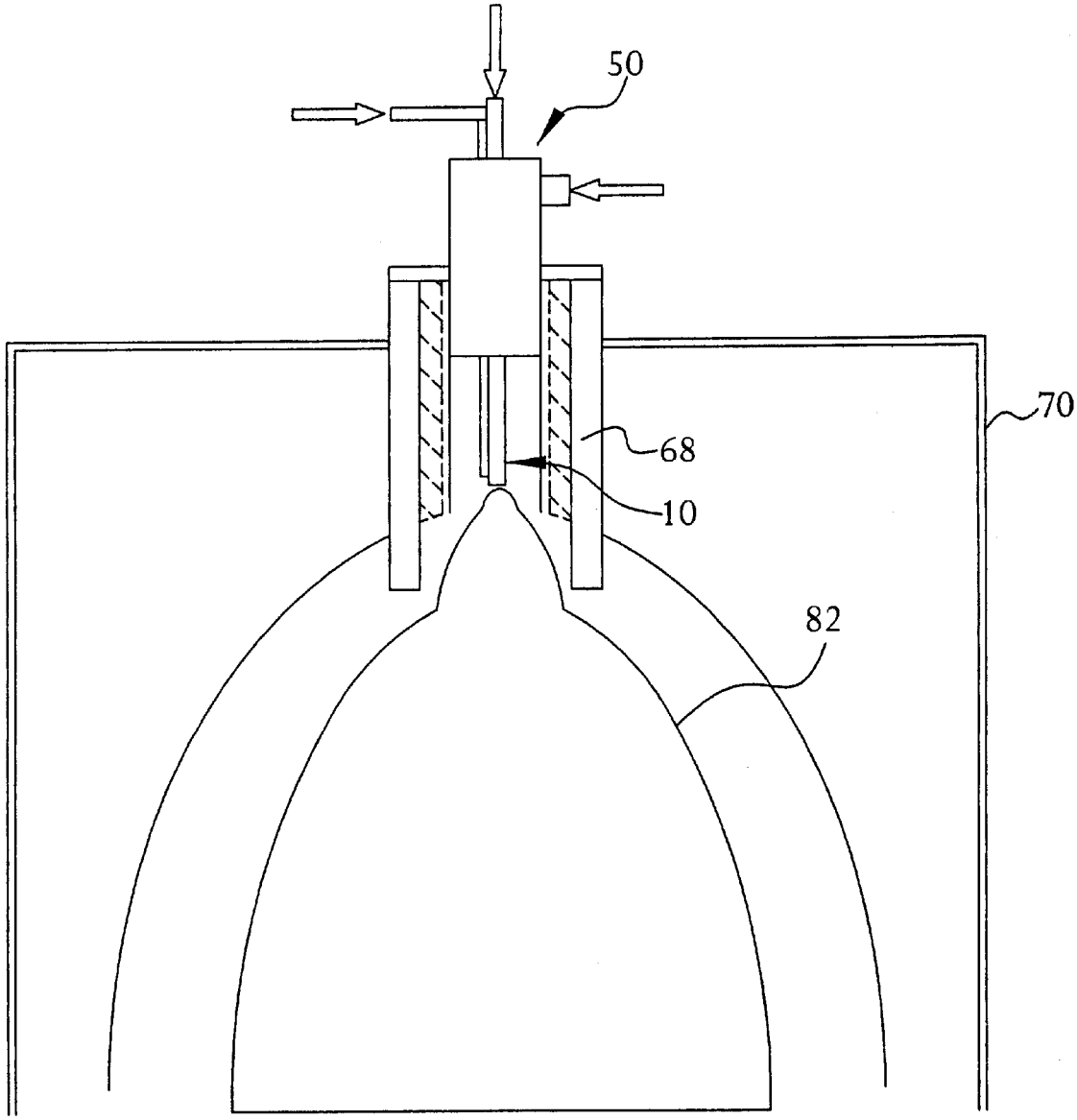
FIG. 6, is a front elevational schematic of the apparatus of the present invention demonstrating an alternate method of operation in a working environment.

As shown in FIG. 6 the atomization device 10 can be retracted inside the burner block 66 to provide for a narrower flame 82 inside of the gasification vessel 70.

With a device according to the present invention, since there is a single relatively large-diameter liquid fuel orifice, plugging and erosion problems caused by prior art devices using multiple orifices for the waste liquid fuel can be minimized or eliminated.

An apparatus according to the invention permits a user to have safe atomization with oxygen thus increasing the overall efficiency of the process by eliminating nitrogen or minimizing steam (water) throughput which has been one of the solutions to atomization problem with prior art devices.

An apparatus according to the present invention eliminates the need for water cooling by maintaining an oxygen shield around the atomizing nozzle assembly.

The present invention permits the operator to adjust the flame during operation which is critical for optimization in many processes such as in a black liquor gasification process. The flame can be adjusted by positioning of the atomizer tip within the outer tube of the pre-combustor, by increasing or decreasing the atomization fluid gas which increases or decreases atomizing fluid velocity, and/or by varying the ratio of oxygen that is used for atomization against the oxygen used for combustion.

In operating a black liquor gasifier it has been conventional practice to preheat the gasifier to a temperature above the self ignition temperature (i.e. greater than 1400° F.) using a preheating burner. Once the preheating burner has heated the gasifier, the preheating burner is removed and the main burner is installed and a start sequence initiated. The burner of the present invention enables easier start-up of the gasifier by eliminating the need for preheat burner. Thus, preheating and simultaneous pressurization of the system is accomplished by initially operating the burner with start-up fuel, then replacing the start-up fuel with the liquid fuel after the desired temperature and pressure of the gasification vessel are achieved. The burner of the present invention is particularly suited for gasification of black liquor. With a device according to the present invention black liquor is introduced to the central tube of the atomization device 10 through a single orifice at a relatively low velocity which should not exceed 200 feet per second. The atomizing oxygen is introduced into the atomization device 20 and should exit the atomization device at a linear velocity of greater than 400 feet per second preferably greater than 600 feet per second. With a device of the present invention 80% or less of the total oxygen needed for combustion can be introduced as the atomizing fluid at a pressure at about 20 to 80 psig relative to the internal pressure of the black liquor oxidation reactor.

A burner according to the present invention permits operating adjustments so that the atomizer and pilot burners can be positioned relative to the end of the precombustor. This will affect the flame shape, mixing and carbon burnout. The position of the black liquor orifice and the atomization device 10 relative to the atomizing fluid can affect droplet distribution, i.e., quality of atomization which is critical for burnout.

A burner according to the present invention can be modified by changing the atomizing fluid swirl vanes to have angles between 0 and 60° relative to the burner access which can make long and narrow or short and wide flames respectively. Also, combustion oxygen swirl can be varied to effect flame shape and mixing.

Coating of the internal portion of the atomizing orifice with an abrasion resistant coating, e.g. alumina, will prolong the burner life in extended time between schedule maintenance shut downs.

Thus, a burner according to the present invention when used in a black liquor gasification system can provide significant benefits. These are using a single orifice atomizer with minimize plugging and erosion. Shielding of the atomizer with combustion oxygen provides for a clean operation and intensely a long burner life with reduced burner-induced shut down. The adjustable feature of the atomizer permits optimization of the flame during operation. Varying of the swirl for both atomizing fluid and combustion oxygen provides the user with the capability of optimizing flame shape. Use of a continuous pilot flame provides improved safety and lack of water cooling provides for a minimum maintenance of the burner.

Having thus described our invention what is desired to be secured by Letters Patent of the United States is set forth in the appended claims, which should be read without limitation.

What is claimed:

1. A burner for introducing an atomizing fluid and a black liquor into a high temperature high pressure gasification vessel comprising in combination:

a generally cylindrical burner housing having a first end and a second end, said housing adapted to be mounted into an outer wall of said gasification vessel with said second end of said housing positioned to direct a flame longitudinally within said gasification vessel;

means in said housing to direct a flow of gaseous oxidant from proximate a first end toward a second end of said housing;

atomization means disposed along a longitudinal axis of said housing and extending from said first end of said housing to proximate said second end of said housing, said atomization means consisting of an outer generally cylindrical conduit having a first end proximate said first end of said housing and a second end defining a converging nozzle, an inner conduit disposed within said outer conduit and of a diameter to define a generally annular passage between said inner and outer conduits with an atomization tip on an end of said second conduit proximate said second end of said first conduit said atomization tip being of a diameter to engage an inner wall of said outer conduit said atomization tip having means in an outer surface to permit discrete streams of an atomization fluid to flow between said atomization tip and said inner wall of said inner conduit with a swirling motion, said atomization tip terminating in a converging surface generally complimentary in shape to an inner surface of said converging nozzle said converging surface of said atomization tip ending in a nozzle orifice in fluid communication with said inner conduit, said inner conduit adapted to conduct said black liquor from a first end of said burner to said nozzle end of said atomization means, whereby said atomized black liquor exits said atomization means in a swirling flow.

2. A burner according to claim 1, including ignition means proximate said exit end of said atomization means.

3. A burner according to claim 2, wherein said ignition means is an oxy-fuel pilot burner disposed along said atomization means with a flame end of said oxy-fuel pilot burner proximate said nozzle end of said outer conduit of said atomization means.

4. A burner according to claim 1, including means to moveably position said atomization tip relative to said nozzle.

5. A burner according to claim 1, wherein said means on said atomization tip to permit flow of atomization fluid comprises a plurality of generally parallel longitudinal grooves spaced equally around said outer surface of said atomization tip.

6. A burner according to claim 5, wherein the number of grooves or slots is between four and forty.

7. A burner according to claim 1, wherein said means on said atomization tip to permit flow of atomization fluid comprises a plurality of generally parallel grooves disposed around at generally equal spacing and at an angle to a longitudinal axis of said atomization tip.

8. A burner according to 7, wherein the number of grooves is between four and forty.

9. A burner according to claim 7, wherein the angle is between 5° and 60°.

10. A burner for introducing an atomization fluid and liquid slurry into a high temperature high pressure gasification vessel comprising in combination:

a generally cylindrical burner housing having a first end and a second end, said housing adapted to be mounted into an outer wall of said gasification vessel with said second end of said housing positioned to direct a flame longitudinally within said gasification vessel;

means in said housing to direct a flow of gaseous oxidant from proximate a first end toward a second end of said housing;

atomization means disposed along a longitudinal axis of said housing and extending from said first end of said housing to proximate said second end of said housing, said atomization means consisting of an outer generally cylindrical conduit having a first end proximate said first end of said housing and a second end defining a converging nozzle, an inner conduit disposed within said outer conduit and of a diameter to define a generally annular passage between said inner and outer conduits with an atomization tip on an end of said second conduit proximate said second end of said first conduit said atomization tip being of a diameter to engage an inner wall of said outer conduit said atomization tip having means in an outer surface to permit discrete streams of an atomization fluid to flow between said atomization tip and said inner wall of said inner conduit with a swirling motion, said atomization tip terminating in a converging surface generally complimentary in shape to an inner surface of said converging nozzle said converging surface of said atomization tip ending in a nozzle orifice in fluid communication with said inner conduit, said inner conduit adapted to conduct said liquid slurry from a first end of said burner to said nozzle end of said atomization means, whereby said atomized liquid slurry exits said atomization means in a swirling flow.

11. A burner according to claim 10, including ignition means proximate said exit end of said atomization means.

12. A burner according to claim 11, wherein said ignition means is an oxy-fuel pilot burner disposed along said atomization means with a flame end of said oxy-fuel pilot burner proximate said nozzle end of said outer conduit of said atomization means.

13. A burner according to claim 10, including means to moveably position said atomization tip relative to said nozzle.

14. A burner according to claim 10, wherein said means on said atomization tip to permit flow of atomization fluid comprises a plurality of generally parallel longitudinal grooves spaced equally around said outer surface of said atomization tip.

15. A burner according to claim 14, wherein the number of grooves or slots is between 4 and 40.

16. A burner according to claim 10, wherein said means on said atomization tip to permit flow of atomization fluid comprises a plurality of generally parallel grooves disposed around at generally equal spacing and at an angle to a longitudinal axis of said atomization tip.

17. A burner according to claim 16, wherein the number of grooves is between 4 and 40.

18. A burner according to claim 16, wherein the angle is between 5° and 60°.

* * * * *